US006628787B1

(12) United States Patent
McGrath et al.

(10) Patent No.: US 6,628,787 B1
(45) Date of Patent: Sep. 30, 2003

(54) WAVELET CONVERSION OF 3-D AUDIO SIGNALS

(75) Inventors: David Stanley McGrath, Sydney (AU); Adam Richard McKeag, Sydney (AU)

(73) Assignee: Lake Technology Ltd, Ultimo (AU)

( * ) Notice: Subject to any disclaimer, the term of this patent is extended or adjusted under 35 U.S.C. 154(b) by 0 days.

(21) Appl. No.: 09/283,014

(22) Filed: Mar. 31, 1999

(30) Foreign Application Priority Data

Mar. 31, 1998 (AU) ..... PP2725

(51) Int. Cl.[7] ..... H04R 5/00
(52) U.S. Cl. ..... 381/18; 381/17
(58) Field of Search ..... 381/17, 18, 1

(56) References Cited

U.S. PATENT DOCUMENTS 5,757,927 A * 5/1998 Gerzon et al. ..... 381/18

6,259,795 B1 * 7/2001 McGrath ..... 381/18

* cited by examiner

*Primary Examiner*—Ping Lee
(74) *Attorney, Agent, or Firm*—Dov Rosenfeld; Inventek

(57) ABSTRACT

An improved method and apparatus for creating multi-channel (or binaural) signals from a B-format sound-field source is disclosed. The method allows the encoded spatial format (B-format) to be separated into multiple bands, with each band assigned a short-term direction factor, from which the higher-resolution multi-channel (or binaural) output signals may be determined. The direction factor is determined, for each filter band, based on the short-term statistics of the soundfield signals in those bands. Based on this direction factor, the speaker drive signals are computed for each band by panning the signals to drive the nearest speakers. In addition, residual signal components are apportioned to the speaker signals by means of previously known decoding techniques.

3 Claims, 1 Drawing Sheet

WAVELET CONVERSION OF 3-D AUDIO SIGNALS

FIELD OF THE INVENTION

The present invention relates to the utilization of sound spatialization in audio signals.

BACKGROUND OF THE INVENTION

The use of B-format measurements, recordings and playback in the provision of more ideal acoustic reproductions which capture part of the spatial characteristics of an audio reproduction are well known.

In the case of conversion of B-format signals to multiple loudspeakers in a speaker array, there is a well recognized problem due to the spreading of individual virtual sound sources over a large number of playback speaker elements. In the worst case, this can lead to significant errors in a listeners localization of these virtual sound sources, especially if the listener is situated off-center in the speaker array. Likewise, in the case of binaural playback of B-format signals, the approximations inherent in the B-format soundfield can lead to less precise localization of sound sources, and a loss of the out-of-head sensation that is an important part of the binaural playback experience.

SUMMARY OF THE INVENTION

It is an object of the present invention to provide for an improved form of conversion of 3-D Audio Signals for playback over a set of speakers.

In accordance with a first aspect of the present invention, there is provided an apparatus for converting a spatial soundfield signal component set into a set of loudspeaker driving signals, comprising: a filtering means for splitting each component of the spatial soundfield set into a set of frequency bands; a multiplicity of direction determining means, one for each frequency band, interconnected to the filtering means for determining a current corresponding spatial direction for a corresponding frequency band; a panning means connected to each of the direction determining means for panning a first portion of the spatial sound field to a corresponding set of first speakers feeds as determined by the spatial direction; a residual calculation means interconnected to the filtering means and the direction determining means and adapted to extract substantially the first portion from the spatial sound field signal components so as to provide a residual spatial sound field signal component; a residual decoder means interconnected to the residual calculation means and adapted to transform the residual spatial sound field signal into a corresponding set of second speaker feeds; a mixing means for combining the first and second speaker feeds to produce the set of loudspeaker driving signals.

The spatial soundfield signal component set can comprise a B-format set of signals.

In accordance with a further aspect of the present invention, there is provided a method of rendering a soundfield signal component set into a set of loudspeaker driving signals, comprising the steps of: dividing each of the components into a number of frequency bands; for each frequency band: determining a likely signal direction and magnitude; determining a first speaker output feed set for the likely signal direction and magnitude; subtracting the likely signal direction and magnitude from the soundfield component set so as to form a soundfield residual set; determining a second speaker output feed set for the soundfield residual set; combining the first and second speaker output feed set to form the set of loudspeaker driving signals.

In accordance with a further aspect of the present invention, there is provided an apparatus for converting a spatial soundfield signal set into a set of loudspeaker driving signals, comprising: an input means for taking the spatial input signal; a filtering means for splitting each channel of the spatial input into a set of frequency bands; a multiplicity of direction determining means; a multiplicity of panning means; and a mixing means for combining the outputs of the multiple panning means to create the speaker driving output signals wherein the multiplicity of direction determining means is configured such that one direction determining means is associated with one of the frequency bands, and is attached the the frequency output of all filter banks, and configured to derive the direction of arrival from the short-term intensity and phase of each directional component relative to the intensity and phase of the omni-directional component of the soundfield.

Preferably, the panning means is associated with one of the frequency band and is configured to create output speaker drive signals that substantially reproduce the same soundfield signal with the majority of the sound panned to the nearby speakers.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

Figure 1:
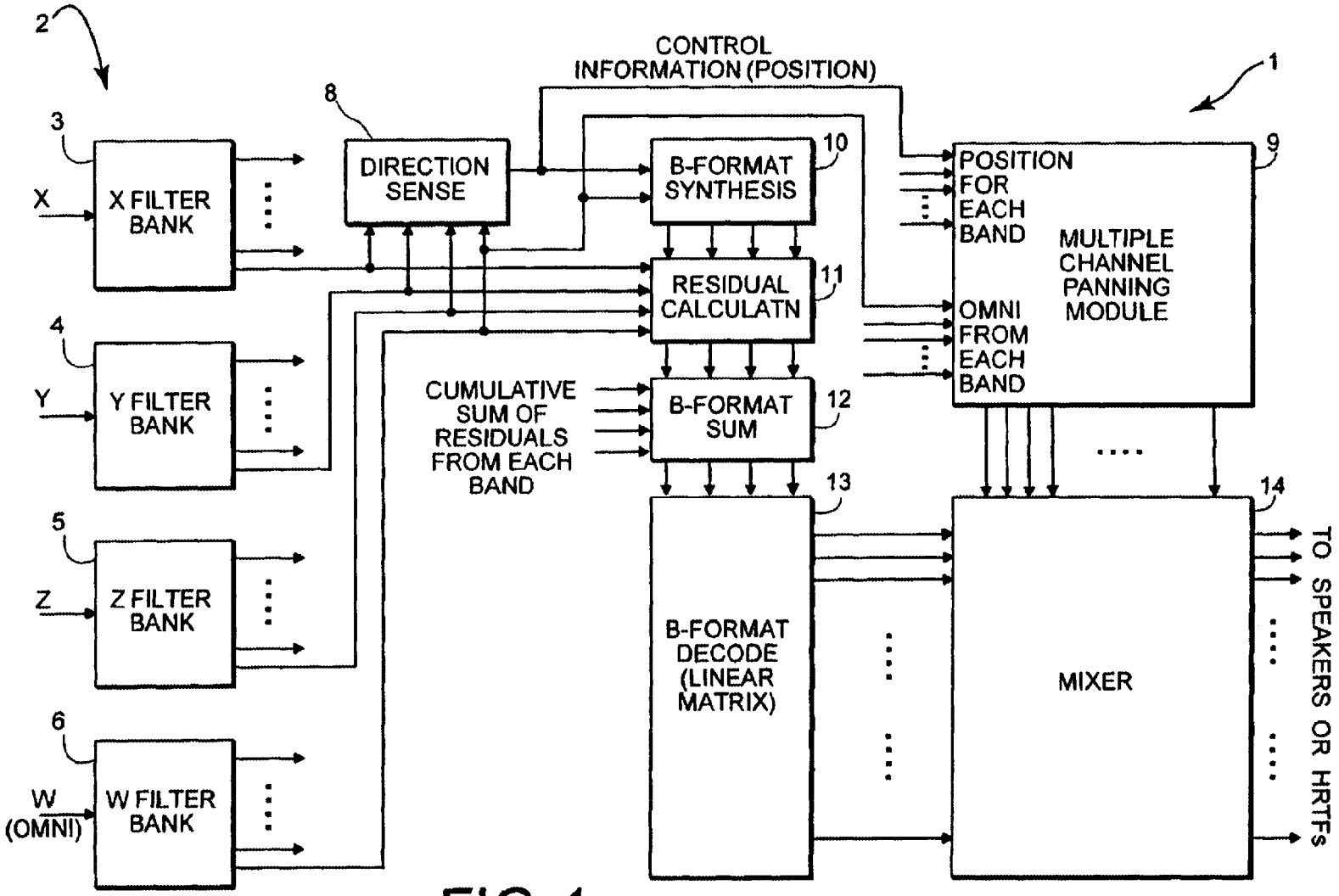
FIG. 1 illustrates schematically, the arrangement of the preferred embodiment.

In discussion of the embodiments of the present invention, it is assumed that the input sound has a three dimensional characteristics and is in an "ambisonic B-format". It should be noted however that the present invention is not limited thereto and can be readily extended to other formats such as SQ, QS, UMX, CD-4, Dolby MP, Dolby surround AC-3, Dolby Pro-logic, Lucas Film THX etc.

The ambisonic B-format system is a very high quality sound positioning system which operates by breaking down the directionality of the sound into spherical harmonic components termed W, X, Y and Z. The ambisonic system is then designed to utilise all output speakers to cooperatively recreate the original directional components.

For a description of the B-format system, reference is made to:

(1) The Internet ambisonic surround sound FAQ available at the following HTTP locations.

http://www.omg.unb.ca/~mleese/ http://www.york.ac.uk/inst/mustech/3d_ audio/ambison.htm http://jrusby.uoregon.edu/mustech. htm The FAQ is also available via anonymous FTP from pacific.cs.unb.ca in a directory/pub/ambisonic. The FAQ is also periodically posted to the Usenet newsgroups mega.audio.tech, rec.audio.pro, rec.audio.misc, rec.audio.opinion.

(2) "General method of theory of auditory localisation", by Michael A Gerzon, 90 sec, Audio Engineering Society Convention, Vienna 24th–27th March 1992.

(3) "Surround Sound Physco Acoustics", M. A. Gerzon, Wireless World, December 1974, pages 483–486.

(4) U.S. Pat. Nos. 4,081,606 and 4,086,433.

The preferred embodiment is directed at providing an improved spatialization of input audio signals. Referring to FIG. 1, there is illustrated schematically the preferred embodiment 1. A B-format signal is input 2 having X,Y,Z and W components. Each component of the B-format input set is processed through a corresponding filter bank 3–6 each of which divides the input into a number of output frequency bands (The number of bands being implementation dependent).

For each frequency band, the four signals (one from each filter bank 3–6) are processed by a direction sense element 8 (only one of which is shown in FIG. 1), which looks at the short-term correlation between the W (omni) channel and each of the three other bands. Based on the correlation sensed by this processing element, an estimate is made of the amplitude, gain and direction of arrival of that particular frequency band at that particular moment in time. The direction information along with the W (omni) channel is then fed into the multiple channel panning module 9 (along with the direction and omni information for other frequency bands). The module 9 pans the W channel to the nearest speaker pair (in the case of a horizontal speaker array) so as to re-create the desired amplitude and direction of arrival.

The direction and omni information is also forwarded to B-format synthesis element 10. The B-format synthesis element 10 re-creates the same directionally panned omni signal, as a B-format signal set, effectively mimicking the same soundfield that would be created by the speaker panning module 9. There is one B-format synthesis element 10 for each band of the filterbanks. This synthesized B-format signal set is then subtracted 11 from the original B-format filter band signal, and summed across all filter bands 12.

The resulting B-format residual signal is fed as input to a standard B-format decoder 13 and represents the residual B-format components that were not already rendered to the speakers by the multiple channel panning module 9. The output of the decoder is combined with the multiple channel panning module outputs by mixer 14, to drive the speakers in the playback array.

The overall effect of the arrangement shown in FIG. 1 is to identify any filter bands that exhibit short term directional characteristics and pan these components directly to the nearest speakers in the playback array. After these directional components are subtracted from the input B-format soundfield, all other components of the B-format soundfield (the residuals) are decoded to the same playback speakers using a conventional B-format decoder.

The loud-speaker signals generate as output in the block diagram of FIG. 1 may also be converted into a binaural signal pair for headphone playback, by passing each speaker-feed through a binaural filter set (a pair of filters, configured to emulate the head-related-transfer-functions from the 'virtual' speaker location to each ear of the listener). These head related transfer functions may be anechoic (thus simulating the virtual speaker array in a dry room) or they may contain acoustic impulse response components that enhance the spatial nature of the playback over headphones.

In addition, in an alternative arrangement, the multiple panning module 9 may, in the alternative, be configured to provide binaural output directly to the mixer 14 and the B-format decoder 13 may be configured to decode B-format directly to binaural output, so that the mixer 14 simply sums together the two sets of binaural signals to produce 2-channel binaural output.

Alternatively, the binaural output may be further adapted for 2-speaker playback by use of crosstalk cancellation techniques.

The preferred embodiment can be implemented by suitable programming of a Digital Signal Processor or Computer System arrangement or can be implemented directly in hardware.

It would be further appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

We claim:

1. An apparatus for converting a spatial soundfield signal component set into a set of loudspeaker driving signals, comprising:

a filtering means for splitting each component of said spatial soundfield set into a set of frequency bands;

a multiplicity of direction determining means, one for each frequency band, interconnected to said filtering means for determining a current corresponding spatial direction for a corresponding frequency band;

a panning means connected to each of said direction determining means for panning a first portion of the spatial sound field to a corresponding set of first speakers feeds as determined by said spatial direction;

a residual calculation means interconnected to said filtering means and said direction determining means and adapted to extract substantially said first portion from said spatial sound field signal components so as to provide a residual spatial sound field signal component;

a residual decoder means interconnected to said residual calculation means and adapted to transform said residual spatial sound field signal into a corresponding set of second speaker feeds;

a mixing means for combining said first and second speaker feeds to produce said set of loudspeaker driving signals.

2. An apparatus as claimed in claim 1 wherein said spatial soundfield signal component set comprise a B-format set of signals.

3. A method of rendering a soundfield signal component set into a set of loudspeaker driving signals, comprising the steps of:

dividing each of said components into a number of frequency bands;

for each frequency band:

determining a likely signal direction and magnitude;

determining a first speaker output feed set for said likely signal direction and magnitude;

subtracting said likely signal direction and magnitude from said soundfield component set so as to form a soundfield residual set;

determining a second speaker output feed set for said soundfield residual set;

combining said first and second speaker output feed set to form said set of loudspeaker driving signals.

* * * * *